US009780427B2

(12) United States Patent
Zhou et al.

(10) Patent No.: US 9,780,427 B2
(45) Date of Patent: Oct. 3, 2017

(54) BANDPASS FILTER AND METHOD OF FABRICATING THE SAME

(75) Inventors: Bo Zhou, Jiangsu (CN); Junyou Chen, Jiangsu (CN); Kun Liu, Jiangsu (CN)

(73) Assignee: TELEFONAKTIEBOLAGET L M ERICSSON, Stockholm (SE)

( * ) Notice: Subject to any disclaimer, the term of this patent is extended or adjusted under 35 U.S.C. 154(b) by 273 days.

(21) Appl. No.: 14/406,211

(22) PCT Filed: Jun. 21, 2012

(86) PCT No.: PCT/CN2012/077338
§ 371 (c)(1),
(2), (4) Date: Mar. 24, 2015

(87) PCT Pub. No.: WO2013/189072
PCT Pub. Date: Dec. 27, 2013

(65) Prior Publication Data

US 2015/0214594 A1 Jul. 30, 2015

(51) Int. Cl.
*H01P 3/08* (2006.01)
*H01P 1/203* (2006.01)
(Continued)

(52) U.S. Cl.
CPC ..... *H01P 1/20309* (2013.01); *H01P 1/20345* (2013.01); *H01P 11/007* (2013.01); *H01P 5/028* (2013.01)

(58) Field of Classification Search
CPC H01P 1/20309; H01P 1/20345; H01P 11/007; H01P 5/028
(Continued)

(56) References Cited

U.S. PATENT DOCUMENTS 6,064,281 A 5/2000 Sheen
6,365,828 B1 * 4/2002 Kinoshita ..... H01L 23/552 174/359
(Continued)

FOREIGN PATENT DOCUMENTS

CN 1153426 A 7/1997
CN 1538553 A 10/2004
(Continued)

OTHER PUBLICATIONS

EuropeanSearch Report, mailed Oct. 23, 2015, in connection with European Application No. 12879349.4, all pages.
(Continued)

*Primary Examiner* — Robert Pascal
*Assistant Examiner* — Kimberly Glenn
(74) *Attorney, Agent, or Firm* — Patents on Demand P.A.; Brian K. Buchheit; Scott M. Garrett

(57) ABSTRACT

The invention provides a bandpass filter, comprising: a substrate with a plurality of dielectric layers; a plurality of resonators; and a plurality of ground layers each having one slot arranged on; wherein the plurality of resonators are arrayed vertically each on respective one of the plurality of dielectric layers alternately without any of offsets, and each of the plurality of ground layers is between adjacent dielectric layers. Adjacent slots are arranged in opposite sides of the ground layers. The invention also provides a method of fabricating the bandpass filter.

32 Claims, 2 Drawing Sheets

(51) Int. Cl.
*H01P 11/00* (2006.01)
*H01P 5/02* (2006.01)

(58) Field of Classification Search
USPC ..... 333/204
See application file for complete search history.

(56) References Cited

U.S. PATENT DOCUMENTS

| | | | | |
|---|---|---|---|---|
| 6,556,099 | B2 * | 4/2003 | Khan | H01P 5/028 333/246 |
| 8,258,897 | B2 * | 9/2012 | Patrick | H01P 1/20336 333/204 |
| 2003/0234706 | A1 | 12/2003 | Silk et al. | |
| 2005/0219123 | A1 | 10/2005 | Hensen et al. | |

FOREIGN PATENT DOCUMENTS

| | | | |
|---|---|---|---|
| CN | 1855612 | A | 11/2006 |
| SU | 1185440 | A1 | 10/1985 |

OTHER PUBLICATIONS

Tze-Min Shen et al., Design of Vertically Stacked Waveguide Filters in LTCC, IEEE Transactions on Microwave Theory and Techniques, Piscataway, NJ, US, vol. 55, No. 8, Aug. 1, 2007, pp. 1771-1779.
Curtis J A et al., Multi-layered planar filters based on aperture coupled, dual mode microstrip or stripline resonators, Microwave Symposium Digest, 1992, IEEE MTT-S International, Albuquerque, NM, USA, Jun. 1-5, 1992, pp. 1203-1206.
PCT International Search Report, mailed Mar. 28, 2013, in connection with International Application No. PCT/CH2012/077338, all pages.
PCT Written Opinion, mailed Mar. 28, 2013, in connection with International Application No. PCT/CH2012/077338, all pages.
Lee, J-H et al. "A Highly Integrated 3-D Millimeter-Wave Filter Using LTCC System-on_Package (SOP) Technology for V-band WLAN Gigabit Wireless Systems" Microwave Conference Proceedings, APMC 2005, Dec. 4-7, 2005, Suzhou, China, IEEE, Piscataway, NJ, USA, vol. 1, pp. 1-3, ISBN: 978-0-7803-9433-9.
Militaru, N. et al. "Aperture Couplings in Multilayer Filtering Structures" Signals, Circuits and Systems, ISSCS 2007, Jul. 1, 2007, IEEE, pp. 1-4, ISBN: 978-1-4244-0968-6.
Hong, Jia-Sheng et al. "Aperture-Coupled Microstrip Open-Loop Resonators and Their Applications to the Design of Novel Microstrip Bandpass Filters" IEEE Transactions on Microwave Theory and Techniques, Sep. 1, 1999, IEEE Service Center, Piscataway, NJ, US, vol. 47, No. 9, pp. 1848-1855, ISSN: 0018-9480 (Check Volume Number).
Dhouib, A. et al. "Numerical and experimental analysis in multilayer coupling structures" 26th European Microwave Conference, Sep. 6, 1996, IEEE, Piscataway, NJ, USA, pp. 705-708, XP031605417.
Wang, H. et al. "A narrow-band hairpin-comb two-pole filter with source-load coupling" IEEE Microwave Components Letters, 2010, vol. 20, No. 7, pp. 372-374.
Chen, K. et al. "Co-design of power amplifier and narrowband filter using high-Q evanescent-mode cavity resonator as the output matching network" IEEE International Microwave Symposium, Montreal, Canada, 2011, pp. 1-4.
Picard, E. et al. "Very narrow band HTS filters without turning for UMTS communications" Proceedings 34th European Microwave Conference, Amsterdam, Netherlands, 2004, pp. 1113-1116.
Hiraga, K. et al. "Multi-layer coupled band-pass filter for 60 GHz LTCC system-on package" Proceedings 2010 IEEE Asia-Pacific Microwave Conference, Japan, pp. 259-261.
Choi, B. et al. "A Ka-band narow bandpass filter using LTCC technology" IEEE Microwave Wireless Components Letters, 2003, vol. 13, No. 9, pp. 388-389.

* cited by examiner

BANDPASS FILTER AND METHOD OF FABRICATING THE SAME

BACKGROUND OF THE INVENTION

Field of Invention

The present invention relates to a bandpass filter in a microwave field, and particularly to a narrow-band bandpass filter and a method of fabricating the same.

Description of Prior Art

Miniaturised microwave narrow-band bandpass filters are increasingly in demand for numerous radar frond-end systems.

Generally, narrow-band bandpass characteristics can be achieved using hairpin structures (referring to [1] Wang. H. and Chu. Q. X.: '*A narrow-band hairpin-comb two-pole filter with source-load coupling', IEEE Microw. Wirel. Compon. Lett.,* 2010, 20, (7), pp. 372-374), slow-wave resonators (referring to [2] Hong. J. S. and Lancaster, M. J.: '*End-coupled microstrip slow-wave resonator filter', Electron. Lett.,* 1996, 32, (16), pp. 1494-1496), cavity resonators (referring to [3] Chen, K., Liu, X., Chappell, W. J. and Peroulis, D.: '*o-design of power amplifier and narrowband filter using high-Q evanescent-mode cavity resonator as the output matching network', IEEE Int. Microwave Symp.*, Montréal, Canada, 2011, pp. 1-4) and high-temperature superconducting (HTS) technology (referring to [4] Picard, E., Madrangeas, V, Bila, S., Mage, J. C. and Marcilhac, B.: '*Very narrow band HTS filters without tuning for UMTS communications', Proc. IEEE* 34*th European Microwave Conf.*, Amsterdam, Netherlands, 2004, pp. 1113-1116). Cascaded end-coupled half-wavelength resonators structured filters using low temperature co-fired ceramic (LTCC) technology can achieve narrow-band bandpass characteristics, but they still occupy large area due to using interdigital structure, especially at low frequency (referring to [5] Hiraga, K., Seki, T., Nishikawa, K. and Uehara, K.: '*Multi-layer coupled band-pass filter for* 60 *GHz LTCC system-on package', Proc. IEEE Asia-Pacific Microwave Conf.*, Japan, 2010, pp. 259-261; [6] Choi, B. G, Stubbs, M. G and Park, C. S.: '*A Ka-band narrow bandpass filter using LTCC technology', IEEE Microw. Wirel. Compon. Lett.,* 2003, 13, pp 388-389; and [7] J.-H. Lee, N. Kidera, S. Pinel, J. Papapolymerou, J. Laskar and M. M. Tentzeris: *'A highly integrated* 3-*D Millimeter-wave filter using LTCC system-on package technology for V-band WLAN Gigabit Wireless Systems', IEEE Microwave Conference Proceedings* 2005, *APMC* 2005, 2005.12.4~7, *Vol.* 1), all of which are incorporated herein by reference.

Some of conventional implementations using planar cascaded half-wavelength resonators occupy large area, and it's hard to obtain expected gap space (capacitive coupling) between adjacent conductors, due to shrinkage after co-firing and restricted resolution of a filter manufacture process with a limited space of 150 μm between adjacent conductors, which is too large to obtain expected capacitive coupling. Additionally, although some of current techniques may mention a filter of a vertically stacked structure, e.g. the filter as proposed in [7], such a filter may still occupy larger space due to its interdigital structure with its top and bottom resonators having offsets from its middle cavity resonators. Also, such a filter may have some difficulty in fabrication, since the filter may need a slot-coupled cavity structure with slots each being located at a middle position under each cavity resonator in connection with via fences, in order to achieve a better performance for transmitting signals.

SUMMARY OF THE INVENTION

Accordingly, a main object of the present invention is to provide a compact bandpass filter using cascaded end-coupled resonators arrayed vertically and a method of fabricating the same, so as to implement a size reduction and a precise controlling end-coupling strength between two adjacent resonators, compared with conventional planar implementations.

In an aspect of the present invention, a bandpass filter is provided. The bandpass filter comprises: a substrate with a plurality of dielectric layers; a plurality of resonators; and a plurality of ground layers each having one slot arranged on, wherein the plurality of resonators are arrayed vertically each on respective one of the plurality of dielectric layers alternately without any of offsets, each of the plurality of ground layers is between adjacent dielectric layers, and adjacent slots are arranged in opposite sides of the ground layers.

In another aspect of the present invention, a method of fabricating a bandpass filter is provided. The method comprises: placing a resonator on a dielectric layer and placing a ground layer on which a slot is arranged on another dielectric layer; alternately stacking a plurality of the dielectric layers on which the resonators are placed and a plurality of the another dielectric layers on which the ground layers are placed; laminating and co-firing all of the stacked dielectric layers to form a substrate with a multi-layer structure.

Preferably, an input port is formed by the resonator made of a microstrip line on a top dielectric layer; and an output port is formed by the resonator made of a microstrip line on a bottom dielectric layer.

Preferably, the remaining resonators are made of strip lines.

Preferably, the micro-strip line and the strip line have same characteristic impedance.

Preferably, at least one end of each resonator is at least overlapped in part with each slot in a vertical direction of the substrate perspectively.

Preferably, an equivalent capacitance is formed by adjacent resonators, a corresponding slot of their intermedial ground layer, and the adjacent dielectric layers between which the intermedial ground layer is placed.

Preferably, the two equivalent capacitances associated with the resonators on a top dielectric layer and a bottom dielectric layer respectively are equal and larger than the remaining equivalent capacitances which are also equal.

Preferably, respective dielectric layers of the substrate are made of one of low temperature co-fired ceramic LTCC Ferro-A6, LTCC DuPont 951, DuPont 943 and PCB.

Preferably, each of the layers has a dielectric constant of 5.9, a loss tangent of 0.002, and a post-fired thickness of 0.1 mm, when the layers are made of the LTCC Ferro-A6.

Preferably, each of the plurality of resonators has a characteristic impedance of 50'Ω and an electrical length of half-wavelength 6.57 mm at 9.39 GHz.

Preferably, each of the slots is rectangle-shaped.

Preferably, an end-coupling strength between adjacent resonators is determined by dimensions of the slot of their intermedial ground layer.

Preferably, 2(N−1) dielectric layers of the substrate has (2N−1) surfaces for alternately placing N resonators and (N−1) ground layers each with one slot, wherein a $n^{th}$ resonator is placed on a $(2n-1)^{th}$ surface, and a $m^{th}$ ground layer with a $m^{th}$ slot is placed on a $(2m)^{th}$ surface, where $1 \leq m \leq (N-1)$, $1 \leq n \leq N$, and N is a positive integer no less than 3.

Preferably, the bandpass filter is a narrow-band bandpass filter.

Preferably, both the resonator and the ground layer are made of metal.

Preferably, both the resonator and the ground layer are made of gold.

According to the present invention, a compact bandpass filter structure may be provided. A main advantage of using the provided structure is for size reduction and precise controlling the end-coupling strength between the two adjacent resonators compared with conventional planar implementations because of the shrinkage after co-firing and restricted resolution of the filter manufacture process with a limited space of 150 μm between adjacent conductors. Furthermore, according to the present invention, the compact bandpass filter of an end-coupled structure with slots is easier to fabricate and has a high production yield, compared to the filter structure in the prior art.

BRIEF DESCRIPTION OF THE DRAWINGS

The objects, advantages and characteristics of the present invention will be more apparent, according to descriptions of preferred embodiments in connection with the drawings, wherein.

Figure 1:
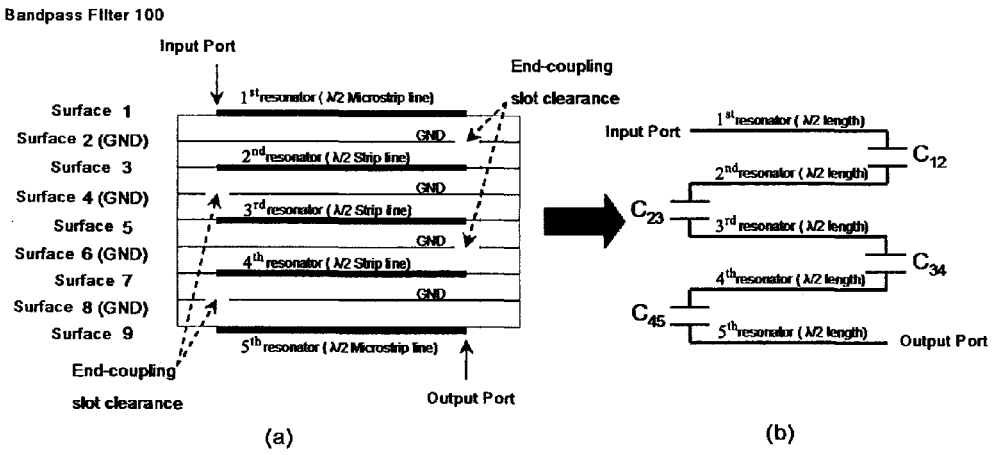
FIG. 1(*a*)-(*b*) illustratively show a schematic front view of a bandpass filter according to an exemplary embodiment of the present invention as well as an equivalent circuit diagram thereof, respectively.

It should be noted that various parts in the drawings are not drawn to scale, but only for an illustrative purpose, and thus should not be understood as any limitations and constraints on the scope of the present invention.

DETAILED DESCRIPTION OF PREFERRED EMBODIMENTS

Hereinafter, the present invention will be further described in detail by referring to the drawings and exemplary embodiments in order to make the objects, technical scheme and advantages of the present invention more apparent. In the description, details and functions which are unnecessary to the present invention are omitted for clarity. In the exemplary embodiments, dielectric layers consisting of a substrate for fabricating a bandpass filter may be made of LTCC Ferro-A6 material as an example. However, it should be appreciated that the exemplary embodiments are only used for illustration but not for any limitation. Other dielectric materials may also be used for the bandpass filter of the present invention, such as LTCC DuPont 951, DuPont 943 and PCB etc.

According to the exemplary embodiment of the present invention, a compact bandpass filter structure may comprise a substrate with a plurality of dielectric layers, a plurality of resonators, and a plurality of ground layers each having one slot arranged on. Each of the plurality of resonators may be arrayed vertically on respective one of the plurality of dielectric layers alternately. Preferably, each of the plurality of resonators may be arrayed vertically without any of offsets. Respective ground layers each with one slot may be between adjacent dielectric layers. Adjacent slots may be arranged in opposite sides of the ground layers. Thus, in the present invention, cascaded end-coupled resonators may be formed. Generally, the resonator and the ground layer in the present invention may be made of metal, such as gold, silver, etc.

Hereinafter, the exemplary bandpass filter structure according to the present invention may be described in detail with reference to FIGS. 1(*a*)-(*b*) and 2 (*a*)-(*c*).

FIG. 1(*a*)-(*b*) illustratively show a schematic front view of a bandpass filter 100 according to an exemplary embodiment of the present invention as well as an equivalent circuit diagram thereof, respectively. And FIGS. 2(*a*)-(*c*) illustratively show a perspective view, a top view and a bottom view of a schematic layout of the bandpass filter 100 as shown in FIG. 1(*a*), respectively.

In the example as shown in FIG. 1(*a*), the bandpass filter 100 may consist of five resonators made of gold. $1^{st}$, $2^{nd}$, $3^{rd}$, $4^{th}$ and $5^{th}$ resonators may be vertically arrayed on $1^{st}$, $3^{rd}$, $5^{th}$, $7^{th}$ and $9^{th}$ surfaces of eight LTCC layers without any of offsets, respectively. Ground layers may be placed on $2^{nd}$, $4^{th}$, $6^{th}$ and $8^{th}$ surfaces of the eight LTCC layers. The ground layers may be made of e.g. gold for isolating broadside coupling effect between adjacent resonators, wherein each of the ground layers may have a slot. An input port may be formed by the $1^{st}$ resonator on the $1^{st}$ surface (i.e., a top LTCC layer). An output port may be formed by the $5^{th}$ resonator on the $9^{th}$ surface (i.e., a bottom LTCC layer).

Obviously, the numbers of the resonators, of the ground layers with the slots, and of the LTCC layers may be associated with each other. That is, 2(N−1) LTCC layers of the substrate may have (2N−1) surfaces for alternately placing N resonators and (N−1) ground layers with slots. In particular, the $n^{th}$ resonator may be placed on the $(2n-1)^{th}$ surface, and the $m^{th}$ ground layer with the $m^{th}$ slot may be placed on the $(2m)^{th}$ surface, where $1 \leq m \leq (N-1)$, $1 \leq n \leq N$, and N is a positive integer lager than 1.

Thus, it should be appreciated that any number of the resonators may be possible. The number of the resonators may depend on a design demand of the bandpass filter 100. The narrower the band of the bandpass filter 100 is required, the larger the number of the resonators is. In practice, the number of the resonators (i.e., N) may be no less than 3.

Figure 2:
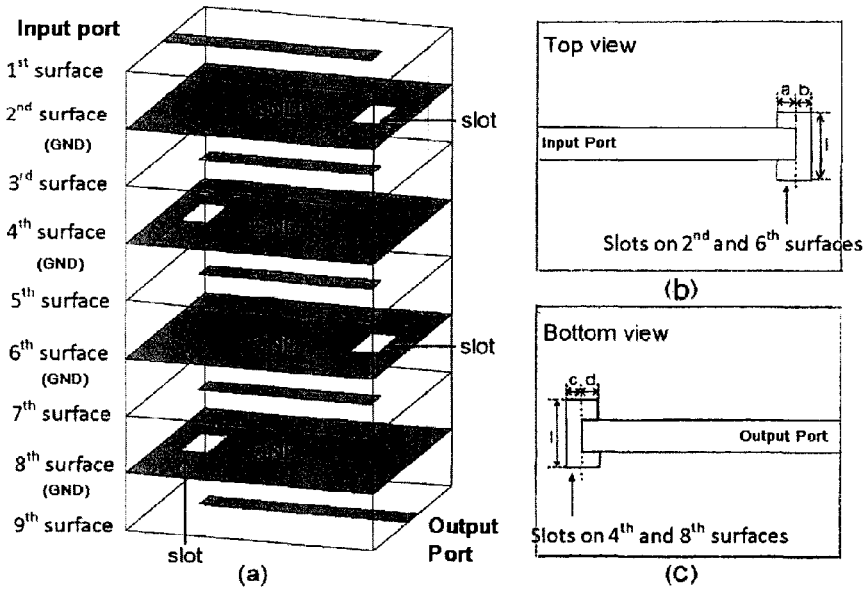
FIG. 2 (*a*)-(*c*) illustratively show a perspective view, a top view and a bottom view of a schematic layout of an exemplary LTCC filter according to an embodiment of the present invention, respectively.

As shown in the perspective view of FIG. 2(*a*), adjacent slots may be arranged in opposite sides of the ground layers. It may also be seen from the top view of FIG. 2(*b*) and the bottom view of FIG. 2(*c*) that at least one end of each resonator may be at least overlapped in part with each slot in a vertical direction of the substrate perspectively. Although FIG. 2(*a*)-(*c*) illustratively show rectangle-shaped slots, it should be appreciated that the rectangle-shaped slot is only illustrated here for its simple dimensional parameters, and other shapes of the slot, such as a circular slot, an elliptic slot, may also be possible, which are easily contemplated by the skilled in the art.

Turning back to FIG. 1(*b*), FIG. 1(*b*) shows the equivalent circuit diagram of the bandpass filter 100 in FIG. 1(*a*). An equivalent capacitance may be formed by the adjacent resonators, the corresponding slot of their intermedial ground layer, and the adjacent dielectric layers between which the intermedial ground layer is placed. For example, as shown in FIG. 1(*b*), the equivalent capacitance C12 may be formed by the $1^{st}$ and $2^{nd}$ resonators, the $1^{st}$ slot and the $1^{st}$ and $2^{nd}$ LTCC layers; the equivalent capacitance C23 may be formed by the $2^{nd}$ and $3^{rd}$ resonators, the $2^{nd}$ slot and the $3^{rd}$ and $4^{th}$ LTCC layers; and so on.

Thus, the equivalent capacitance may be affected by various factors related to the adjacent resonators, the slot and the adjacent LTCC layers which may constitute the equivalent capacitance. For example, characteristic impedance, an electrical length of the resonator, dimensions of the slot (e.g. "a", "b", "c", "d" and "l" in FIGS. 2(*b*) and (*c*)), a relative position between the resonator and the slot (e.g. "a" and "b" in FIGS. 2(*b*), and "c" and "d" in FIGS. 2(*c*)), and dielectric constant of the LTCC layer, etc.

In the present embodiment, each LTCC layer has a post-fired thickness of 0.1 mm in Ferro-A6 material with a dielectric constant of 5.9 and loss tangent of 0.002. However, it may be appreciated that different materials may have different property parameters. The characteristic impedance of each resonator is 50'Ω, and the electrical length of each resonator is half-wavelength (6.57 mm) at 9.39 GHz.

As an example, let respective dimensions of respective slots a=d=0.8 mm, and b=c=0.4 mm. Table 1 lists the equivalent capacitances of the bandpass filter 100 in this situation.

TABLE 1

| | Equivalent capacitance | | | |
|---|---|---|---|---|
| | $C_{12}$ | $C_{23}$ | $C_{34}$ | $C_{45}$ |
| Unit (fF) | 46 | 8 | 8 | 46 |

As shown in Table 1, (C12=C45)>(C23=C34). That is because the $1^{st}$ and $5^{th}$ resonators are microstrip lines on top and bottom layers, respectively, and the $2^{nd}$, $3^{rd}$ and $4^{th}$ resonators are strip lines on the $2^{nd}$, $3^{rd}$ and $4^{th}$ layers, respectively. As well-known by the skilled in the art, the microstrip line may be placed between air and dielectric, and the strip line may be placed between two dielectrics. Each of the resonators has a length of half-wavelength and characteristic impedance of 50Ω. As well-known by the skilled in the art, the half-wavelength and the characteristic impedance of the resonator may depend on properties of the resonator. Especially, the half-wavelength of the resonator may be mainly dependent on a length of the resonator, and the characteristic impedance of the resonator may be mainly dependent on the width of the resonator. Due to the $1^{st}$ and $5^{th}$ resonators are microstrip lines and the $2^{nd}$, $3^{rd}$ and $4^{th}$ resonators are strip lines, the lengths and widths of the half-wavelength resonators may be slightly different for the resonators made of the microstrip lines and the resonator made of the strip lines. However, such a minor difference in both the length and the width may be ignored. Thus, as shown in FIG. 1(*a*), the lengths and the widths of the five resonators are substantially the same.

End-coupling strength between the adjacent resonators may be associated with the equivalent capacitance of the adjacent resonators, and may be controlled by the dimensions of the rectangle-shaped slot of the intermediate ground layer.

Thus, both the end-coupling strength and the equivalent capacitance may be determined by dimensions of the rectangle-shaped slot of the intermedial ground layer between the LTCC layers on which the adjacent resonators are placed. The larger the dimensions of the rectangle-shaped slot are, the larger the end-coupling strength and the equivalent capacitance are.

According to the exemplary embodiment of the present invention as shown in FIG. 1(*a*), the LTCC bandpass filter using five cascaded end-coupled resonators arrayed vertically without any of offsets based on the Ferro-A6 substrate may provide a compact narrow-band bandpass filter structure. A 3 dB fractional bandwidth of 3% and a size reduction of 80% may be achieved. Additionally, the LTCC bandpass filter described in the exemplary embodiment of the present invention is easier to fabricate and has a high production yield compared to the current filter structure.

Figure 3:
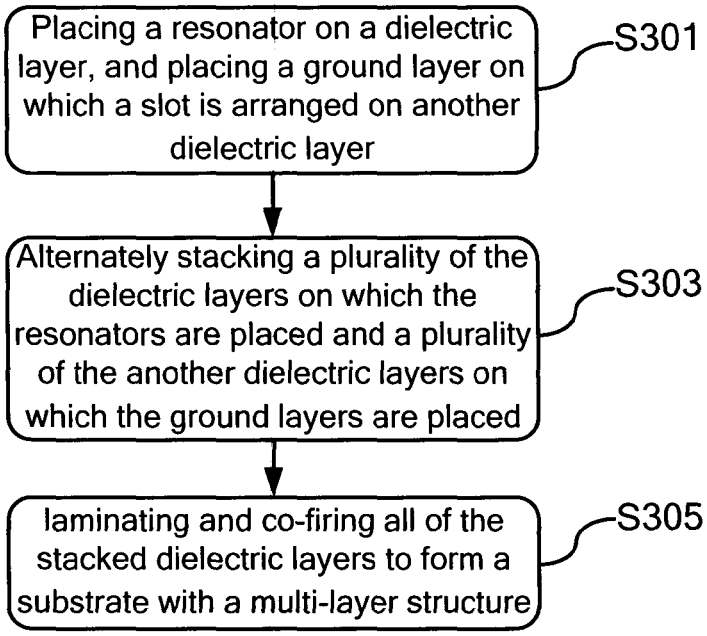
FIG. 3 shows an illustrative flowchart of a method of fabricating an exemplary LTCC filter according to an embodiment of the present invention.

FIG. 3 shows an illustrative flowchart of a method of fabricating an exemplary LTCC filter according to an embodiment of the present invention. It should be noted that fabricating steps which are not essential to the present invention are omitted for clarity.

In step S301, a resonator may be placed on a dielectric layer, and a ground layer on which a slot is arranged may be placed on another dielectric layer.

In step S303, a plurality of the dielectric layers on which the resonators are placed and a plurality of the another dielectric layers on which the ground layers are placed may be alternately stacked.

In step S305, all of the stacked dielectric layers may be laminated and co-fired to form a substrate encapsulation with a multi-layer structure.

In the substrate encapsulation, the resonators may be arrayed vertically without any of offsets, adjacent slots may be arranged in opposite sides of the ground layers, and at least one end of each resonator may be at least overlapped in part with each slot in a vertical direction of the substrate perspectively.

Figure 4:
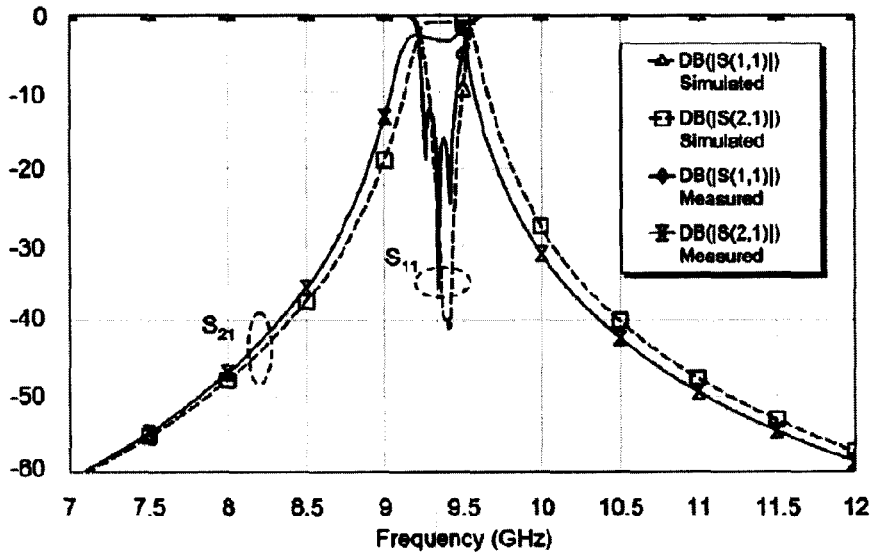
FIG. 4 illustratively shows a diagram of simulated v.s. measured S-parameters of an exemplary LTCC filter according to an embodiment of the present invention.

FIG. 4 shows a diagram of simulated v.s. measured S-parameters of the bandpass filter 100 according to the exemplary embodiment of the present invention as shown in FIG. 1 (*a*).

As shown in FIG. 4, the simulated S-parameters $S_{11}$ and $S_{21}$ of the bandpass filter 100 are better than −15 and −2 dB in the passband with a 3 dB fractional bandwidth of 3% at center frequency of 9.39 GHz, respectively. Measured results agree well with the simulated ones.

Therefore, the compact bandpass filter structure as provided in the present invention may achieve the advantage of size reduction and precise controlling the end-coupling strength between the two adjacent resonators compared with conventional planar implementations because of the shrinkage after co-firing and restricted resolution of a filter manufacture process with a limited space of 150 μm between adjacent conductors. Furthermore, according to the present invention, the compact bandpass filter of an end-coupled structure with slots is easier to fabricate and has a high production yield, compared to the filter structure in the prior art.

The above is only the preferred embodiments of the present invention and the present invention is not limited to the above embodiments. Therefore, any modifications, substitutions and improvements to the present invention are possible without departing from the spirit and scope of the present invention.

What is claimed is:

1. A bandpass filter, comprising:

a substrate with a plurality of dielectric layers;

a plurality of resonators; and a plurality of ground layers each having one slot arranged on;

wherein the plurality of resonators are arrayed vertically each on respective one of the plurality of dielectric layers alternately without any of offsets, each of the plurality of ground layers is between adjacent dielectric layers, and adjacent slots are arranged in opposite sides of the ground layers.

2. The bandpass filter according to claim 1, wherein:

an input port is formed by the resonator made of a microstrip line on a top dielectric layer of the plurality of dielectric layers; and an output port is formed by the resonator made of a microstrip line on a bottom dielectric layer of the plurality of dielectric layers.

3. The bandpass filter according to claim 2, wherein the remaining resonators are made of strip lines.

4. The bandpass filter according to claim 3, wherein the micro-strip line and the strip line have a same characteristic impedance.

5. The bandpass filter according to claim 3, wherein at least one end of each resonator is at least overlapped in part with each slot in a vertical direction of the substrate perspectively.

6. The bandpass filter according to claim 1, wherein an equivalent capacitance is formed by adjacent resonators of the plurality of resonators, a corresponding slot of their intermedial ground layer, and the adjacent dielectric layers between which the intermedial ground layer is placed.

7. The bandpass filter according to claim 6, wherein the two equivalent capacitances associated with the resonators on a top dielectric layer and a bottom dielectric layer of the plurality of dielectric layers respectively are equal and larger than the remaining equivalent capacitances which are also equal.

8. The bandpass filter according to claim 1, wherein the plurality of dielectric layers of the substrate are made of one of low temperature co-fired ceramic LTCC Ferro-A6, LTCC DuPont 951, DuPont 943 and PCB.

9. The bandpass filter according to claim 8, wherein each of the layers has a dielectric constant of 5.9, a loss tangent of 0.002, and a post-fired thickness of 0.1 mm, when the layers are made of the LTCC Ferro-A6.

10. The bandpass filter according to claim 9, wherein each of the plurality of resonators has a characteristic impedance of 50'Ω and an electrical length of half-wavelength 6.57 mm at 9.39 GHz.

11. The bandpass filter according to claim 1, wherein each of the slots is rectangle-shaped.

12. The bandpass filter according to claim 1, wherein an end-coupling strength between adjacent resonators is determined by dimensions of the slot of their intermedial ground layer.

13. The bandpass filter according to claim 1, wherein 2(N−1) dielectric layers of the plurality of dielectric layers of the substrate has (2N−1) surfaces for alternately placing N resonators of the plurality of resonators and (N−1) ground layers of the plurality of ground layers, each with one slot, wherein a $n^{th}$ resonator of the plurality of resonators is placed on a $(2n-1)^{th}$ surface, and a $m^{th}$ ground layer of the plurality of ground layers with a $m^{th}$ slot is placed on a $(2m)^{th}$ surface, where $1 \le m \le (N-1)$, $1 \le n \le N$, and N is a positive integer no less than 3.

14. The bandpass filter according to claim 1, wherein the bandpass filter is a narrow-band bandpass filter.

15. The bandpass filter according to claim 1, wherein both the resonator and the ground layer are made of metal.

16. The bandpass filter according to claim 15, wherein both the resonator and the ground layer are made of gold.

17. A method of fabricating a bandpass filter, comprising:

placing a resonator on a dielectric layer and placing a ground layer on which a slot is arranged on another dielectric layer;

alternately stacking a plurality of the dielectric layers on which the resonators are placed and a plurality of the another dielectric layers on which the ground layers are placed; and laminating and co-firing all of the stacked dielectric layers to form a substrate with a multi-layer structure;

wherein the resonators are arrayed vertically without any of offsets, and adjacent slots are arranged in opposite sides of the ground layers.

18. The method according to claim 17, wherein:

an input port is formed by the resonator made of a microstrip line on a top dielectric layer of the plurality of the dielectric layers; and an output port is formed by the resonator made of a microstrip line on a bottom dielectric layer of the plurality of the dielectric layers.

19. The method according to claim 18 wherein the remaining resonators are made of strip lines.

20. The method according to claim 19, wherein the micro-strip line and the strip line have a same characteristic impedance.

21. The method according to claim 19, wherein at least one end of each resonator is at least overlapped in part with each slot in a vertical direction of the substrate perspectively.

22. The method according to claim 17, wherein an equivalent capacitance is formed by adjacent resonators of the resonators placed on the plurality of the dielectric layers, a corresponding slot of their intermedial ground layer, and adjacent dielectric layers between which the intermedial-ground layer is placed.

23. The method according to claim 22, wherein the two equivalent capacitances associated with the resonators on a top dielectric layer and a bottom dielectric layer of the plurality of the dielectric layers respectively are equal and larger than the remaining equivalent capacitances which are also equal.

24. The method according to claim 17, wherein dielectric layers of the substrate are made of one of low temperature co-fired ceramic LTCC Ferro-A6, LTCC DuPont 951, DuPont 943 and PCB.

25. The method according to claim 24, wherein each of the layers has a dielectric constant of 5.9, a loss tangent of 0.002, and a post-fired thickness of 0.1 mm, when the layers are made of the LTCC Ferro-A6.

26. The method according to claim 25, wherein each of resonators has a characteristic impedance of 50'Ω and an electrical length of half-wavelength 6.57 mm at 9.39 GHz.

27. The method according to claim 17, wherein each of the slots is rectangle-shaped.

28. The method according to claim 17, wherein an end-coupling strength between adjacent resonators is determined by dimensions of the slot of their intermedial ground layer.

29. The method according to claim 17, wherein 2(N−1) dielectric layers of the plurality of dielectric layers of the substrate has (2N−1) surfaces for alternately placing N resonators of the resonators placed on the plurality of the dielectric layers and (N−1) ground layers of the ground layers placed on the plurality of the another dielectric layers, each with one slot, wherein a $n^{th}$ resonator of the resonators placed on the plurality of the dielectric layers is placed on a $(2n-1)^{th}$ surface, and a $m^{th}$ ground layer, of the ground layers placed on the plurality of the another dielectric layers, with a $m^{th}$ slot is placed on a $(2m)^{th}$ surface, where $1 \leq m \leq (N-1)$, $1 \leq n \leq N$, and N is a positive integer no less than 3.

30. The method according to claim 17, wherein the bandpass filter is a narrow-band bandpass filter.

31. The method according to claim 17, wherein both the resonator and the ground layer are made of metal.

32. The method according to claim 31, wherein both the resonator and the ground layer are made of gold.

* * * * *